US007621542B2

(12) United States Patent
Warburton et al.

(10) Patent No.: US 7,621,542 B2
(45) Date of Patent: Nov. 24, 2009

(54) SNOWBOARD BINDING AND RELATED METHODS

(75) Inventors: Alex Warburton, British Columbia (CA); James Laughlin, Burlington, VT (US); Jared Eberhardt, Long Beach, CA (US)

(73) Assignee: The Burton Corporation, Burlington, VT (US)

( * ) Notice: Subject to any disclaimer, the term of this patent is extended or adjusted under 35 U.S.C. 154(b) by 401 days.

(21) Appl. No.: 11/601,923

(22) Filed: Nov. 20, 2006

(65) Prior Publication Data

US 2008/0116664 A1 May 22, 2008

(51) Int. Cl.
*B62B 9/04* (2006.01)

(52) U.S. Cl. ..... 280/14.22; 280/14.21; 280/628

(58) Field of Classification Search ..... 280/14.22, 280/14.21, 11.36, 624, 617, 618, 611, 633, 280/623, 11.3, 634, 607, 629; 36/118.2, 36/118.3, 118.4, 118.7, 118.8, 118.9
See application file for complete search history.

(56) References Cited

U.S. PATENT DOCUMENTS

| | | | | |
|---|---|---|---|---|
| 5,915,821 | A * | 6/1999 | Okajima et al. | 36/117.1 |
| 5,926,979 | A * | 7/1999 | Borel | 36/115 |
| 6,123,342 | A | 9/2000 | Grell | |
| 6,231,057 | B1 * | 5/2001 | Reuss et al. | 280/14.21 |
| 6,394,484 | B1 | 5/2002 | Maravetz et al. | |
| 6,648,365 | B1 | 11/2003 | Laughlin et al. | |
| 6,736,413 | B2 * | 5/2004 | Laughlin et al. | 280/14.22 |
| 6,758,488 | B2 * | 7/2004 | Laughlin et al. | 280/624 |
| 6,886,850 | B2 | 5/2005 | Taylor et al. | |
| 7,077,403 | B2 * | 7/2006 | Laughlin et al. | 280/11.36 |
| 7,232,132 | B2 | 6/2007 | Elkington | |
| 7,246,811 | B2 * | 7/2007 | Martin | 280/611 |
| 7,367,579 | B2 | 5/2008 | Elkington | |
| 2004/0207178 | A1 | 10/2004 | Laughlin et al. | |
| 2008/0231020 | A1 | 9/2008 | Elkington | |

FOREIGN PATENT DOCUMENTS

| | | |
|---|---|---|
| WO | 00/21618 | 4/2000 |
| WO | 00/24482 | 5/2000 |

OTHER PUBLICATIONS

European Search Report for EP 07120184 mailed Mar. 31, 2008.
"Factory Showroom" Catalog, 1995, pp. 2.

* cited by examiner

*Primary Examiner*—Hau V Phan
(74) *Attorney, Agent, or Firm*—Lando & Anastasi, LLP

(57) ABSTRACT

A snowboard binding for securing a boot to a snowboard includes a base that is mounted on the snowboard. The base includes a base plate and a pair of side rails that extend upwardly from the base plate along lateral sides of the base plate. The snowboard binding further includes a high-back support secured to the pair of side rails. The high-back support is fabricated from a single piece of material and has a hinge formed therein to adjust a forward lean position of the high-back support. Additional design features and methods are disclosed herein.

24 Claims, 6 Drawing Sheets

SNOWBOARD BINDING AND RELATED METHODS

FIELD OF THE INVENTION

Embodiments of the invention are directed generally to the field of bindings for gliding sports, and more particularly to the field of snowboard bindings.

BACKGROUND OF THE INVENTION

Snowboard binding systems used with soft snowboard boots typically are classified as one of two general types. A strap binding typically includes one or more straps that extend across a rider's boot to secure the boot to the binding. In contrast, a step-in binding typically employs one or more strapless engagement members, rather than straps, into which the rider can step to lock the boot into the binding. A strap binding typically delivers a feel or performance many riders find desirable. More particularly, a strap binding allows a rider's foot to roll laterally when riding by allowing the boot to roll relative to the binding.

Most commercially available snowboard bindings typically include a base plate that is mounted on the snowboard to receive the snowboard boot. A heel loop is mounted at the rear of the base plate in a position so that the heel loop surrounds the lower leg of the rider. In some embodiments, the heel loop is adjustable to accommodate different snowboard boot sizes. The snowboard binding may further include a high-back leg support, which is pivotally mounted on the heel loop to provide support to the leg of the rider. With strap binding systems, in certain embodiments, a pair of straps may be provided on side rails of the base plate to secure the rider's snowboard boots within the binding.

A snowboard binding is mounted in a direction substantially across the edges of the board so the rider's toes point towards one edge of the board (the "toe side edge") while the rider's heels are positioned relative to the other edge of the board (the "heel side edge"). The rider may apply pressure on either the toe side edge or the heel side edge to steer the board when carving a turn. The strap binding described above enables the rider to develop a better feel when turning.

SUMMARY OF THE INVENTION

One aspect of the invention is directed to a snowboard binding for securing a boot to a snowboard. In a certain embodiment, the snowboard binding comprises a base configured to be mounted on the snowboard. The base includes a base plate and a pair of side rails that extend upwardly from the base plate along lateral sides of the base plate. The snowboard binding further comprises a high-back support secured to the pair of side rails. The high-back support is fabricated from a single piece of material and has a hinge formed therein to adjust a forward lean position of the high-back support.

Embodiments of the snowboard binding may further include configuring the high-back support to include a main body with the hinge being formed in the main body and a pair of descending arms, one for each side rail. The main body has a top portion and a bottom portion, with the hinge being disposed between the top portion and the bottom portion. The main body has a curved surface at an area surrounding the hinge. The snowboard binding may further comprise a locking mechanism secured to the main body of the high-back support at the curved surface. In one embodiment, the curved surface has teeth formed therein, and the locking mechanism has teeth configured to mate with the teeth of the curved surface. The locking mechanism may be pivotally connected to the main body of the high-back support.

Other embodiments include configuring the arms of the high-back support to pivotally secure to their respective side rails. Each arm may be configured to include a surface configured to engage the base plate of the base to transfer a load from the leg engagement portion to the base plate. In another embodiment, the high-back support is pivotable between a stowed position in which the high-back support is disposed against the base and a use position in which the high-back support extends away from the base. The snowboard binding may further comprise a releasable securing feature associated with the base and the high-back support to releasably secure the high-back support in the use position. The releasable securing feature includes a first interconnecting portion associated with the base adjacent one of the side rails and a second interconnecting portion associated with one of the descending arms. The arrangement is such that the first and second interconnecting portions are releasably engagable with one another for securing the high-back support in its use position. The high-back support may further include a fastener assembly to enable front to back adjustment of the high-back support with respect to the base while the releasable securing feature secures the high-back support in its use position.

Another aspect of the invention is directed to a snowboard binding comprising a base configured to be mounted on the snowboard. The base includes a base plate and a pair of side rails that extend upwardly from the base plate along lateral sides of the base plate. The snowboard binding further includes a high-back support pivotally secured to the pair of side rails. The high-back support is pivotable between a stowed position in which the high-back support is disposed against the base and a use position in which the high-back support extends away from the base. The snowboard binding also includes a releasable securing feature associated with the base and the high-back support to releasably secure the high-back support in the use position.

Certain embodiments of the snowboard binding may further include configuring the high-back support with a main body and a pair of descending arms, one for each side rail. The arrangement is such that the releasable securing feature includes a first interconnecting portion associated with the base adjacent one of the side rails and a second interconnecting portion associated with one of the descending arms. The first and second interconnecting portions are releasably engagable with one another for securing the high-back support in its use position. The high-back support may be further configured to include a fastener assembly to enable a front to back adjustment of the high-back support with respect to the base while the releasable securing feature secures the high-back support in its use position.

Yet another aspect of the invention is directed to a snowboard binding comprising a base configured to be mounted to the snowboard and a high-back support secured to the base. The high-back support includes a main body having a top portion and a bottom portion with a flexible hinge formed between the top portion and the bottom portion to adjust a forward lean position of the high-back support, the main body having a curved surface at an area surrounding the hinge. The snowboard binding further comprises a locking mechanism secured to the main body of the high-back support at the curved surface.

Embodiments of the snowboard binding may include providing the curved surface with teeth that mate with teeth of the locking mechanism.

A further aspect of the invention is directed to a snowboard binding comprising a base configured to be mounted to the snowboard. The base has a base plate and a pair of the side rails that extend upwardly from the base plate along lateral sides of the base plate. The snowboard binding further comprises a high-back support pivotally secured to the pair of side rails. The high-back support has a leg engagement portion and a pair of descending arms, one for each side rail, pivotally connected to the side rails. Each arm includes a surface configured to engage the base plate of the base to transfer a load from the leg engagement portion to the base plate.

Embodiments of the snowboard binding may further include a releasable securing feature associated with the base and the high-back support to releasably secure the high-back support in the use position. In a certain embodiment, the releasable securing feature includes a first interconnecting portion associated with the base adjacent one of the side rails and a second interconnecting portion associated with one of the descending arms. The arrangement is such that the first and second interconnecting portions are releasably engagable with one another for securing the high-back support in its use position.

A further aspect of the invention is directed to a method of adjusting a forward lean position of a snowboard binding of the type including a high-back support having a top portion and a bottom portion separated from the top portion by a flexible hinge. Specifically, the method comprises: flexing the high-back support by moving the top portion of the high-back support with respect to the bottom portion to a desired forward lean position; and locking the high-back support in the desired forward lean position.

In particular embodiments, the step of locking the high-back support in the desired forward lean position includes engaging teeth formed in the high-back portion with teeth formed in a locking mechanism. The method may further comprise pivoting the high-back portion with respect to a base of the snowboard binding.

Another aspect of the invention is directed to a method of securing a high-back support to a base of a snowboard binding in a use position. In particular, the method comprises: releasably securing a feature associated with the base to a feature associated with the high-back support to releasably secure the high-back support in the use position.

In certain embodiments, the step of releasably securing a feature associated with the base to a feature associated with the high-back support comprises interlocking a first interconnecting portion associated with the base adjacent one of the side rails and a second interconnecting portion associated with one of the descending arms. The method may further comprise adjusting the high-back support with respect to the base in a front to back direction while the high-back support is in its use position.

BRIEF DESCRIPTION OF THE DRAWINGS

The foregoing and other objects and advantages of the invention will be appreciated more fully from the following drawings, wherein like reference characters designate like features, in which.

DETAILED DESCRIPTION OF THE INVENTION

Figure 1:
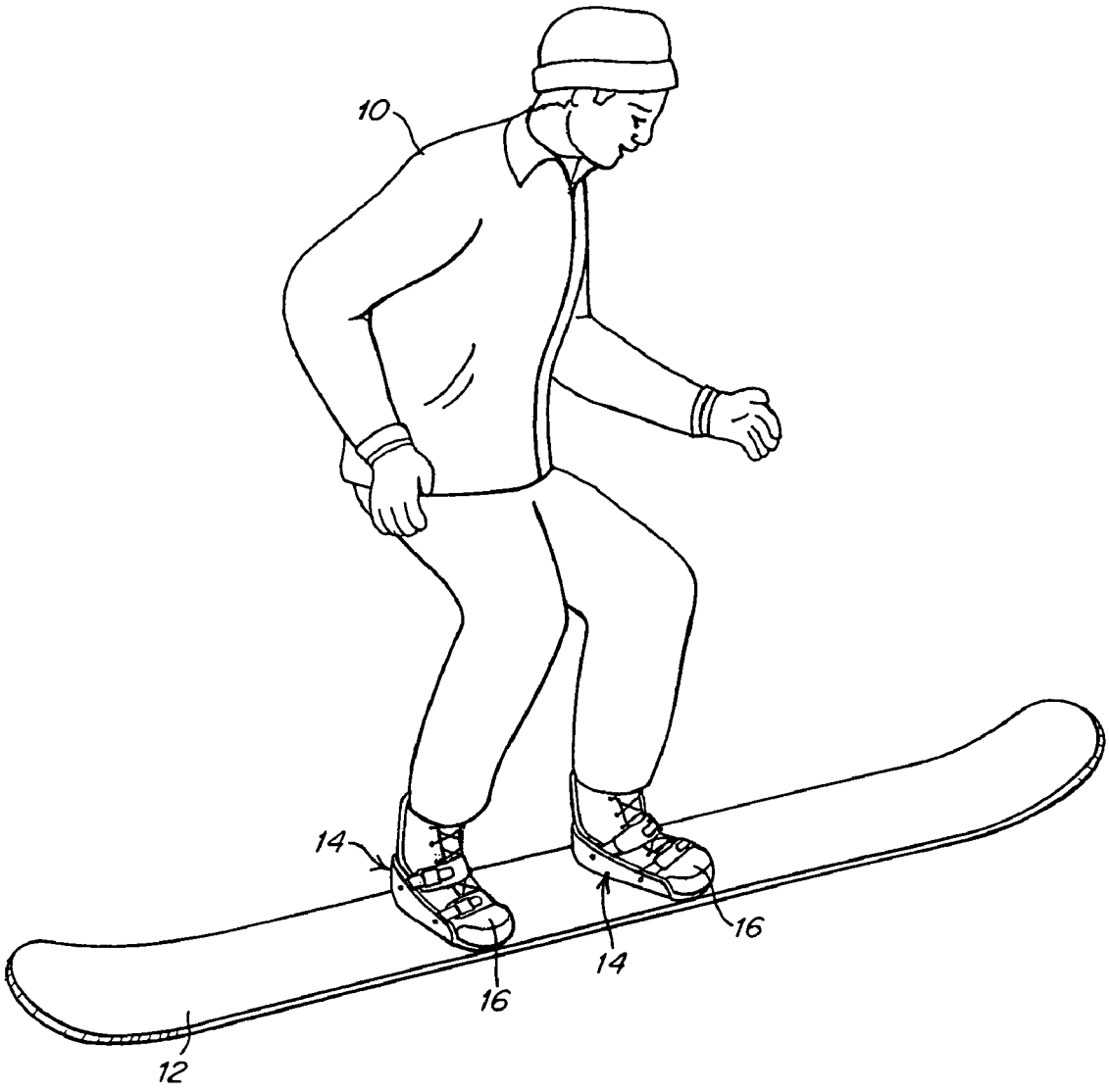
FIG. 1 is a perspective view of a rider mounted to a snowboard using a boot and binding system in accordance with an embodiment of the invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The invention is directed to an improved snowboard binding system that incorporates many of the features of presently available, high-end bindings. Specifically, the binding of embodiments of the invention is meant to be economical in construction and offer the same or increased functionality that is normally associated with more expensive bindings. One cost savings feature is that the binding disclosed herein does not include a separate and distinct heel loop, which is conventionally used to provide adjustment for the size of the rider's boot. Another feature is that the entire binding, except for fasteners, may be fabricated from a low-cost material, such as nylon.

The invention is directed to a binding for a foot, boot, or shoe and, for the purposes of this specification including the claims, the term "boot" shall encompass not only a boot, but also a foot, shoe, and other footwear. Further, although the invention is described in connection with a snowboard boot binding, the inventive arrangement is not so limited, and may be embodied in other devices where a boot is secured including, without limitation, a ski binding, snow shoe, snow skate, snow scooter, and the like. Also, the invention is not limited to a binding used on a device that glides only over snow. Boot bindings used in devices that glide over water, sand, ice, dirt, asphalt, and other surfaces also are within the scope of the invention.

FIG. 1 illustrates a rider 10 on a snowboard 12. A pair of bindings, each generally indicated at 14, in accordance with one illustrative embodiment of the invention, is mounted on the snowboard 12. Each binding 14 is configured to engage a rider's boot 16 to mount the rider 10 to the snowboard 12.

Figure 2:
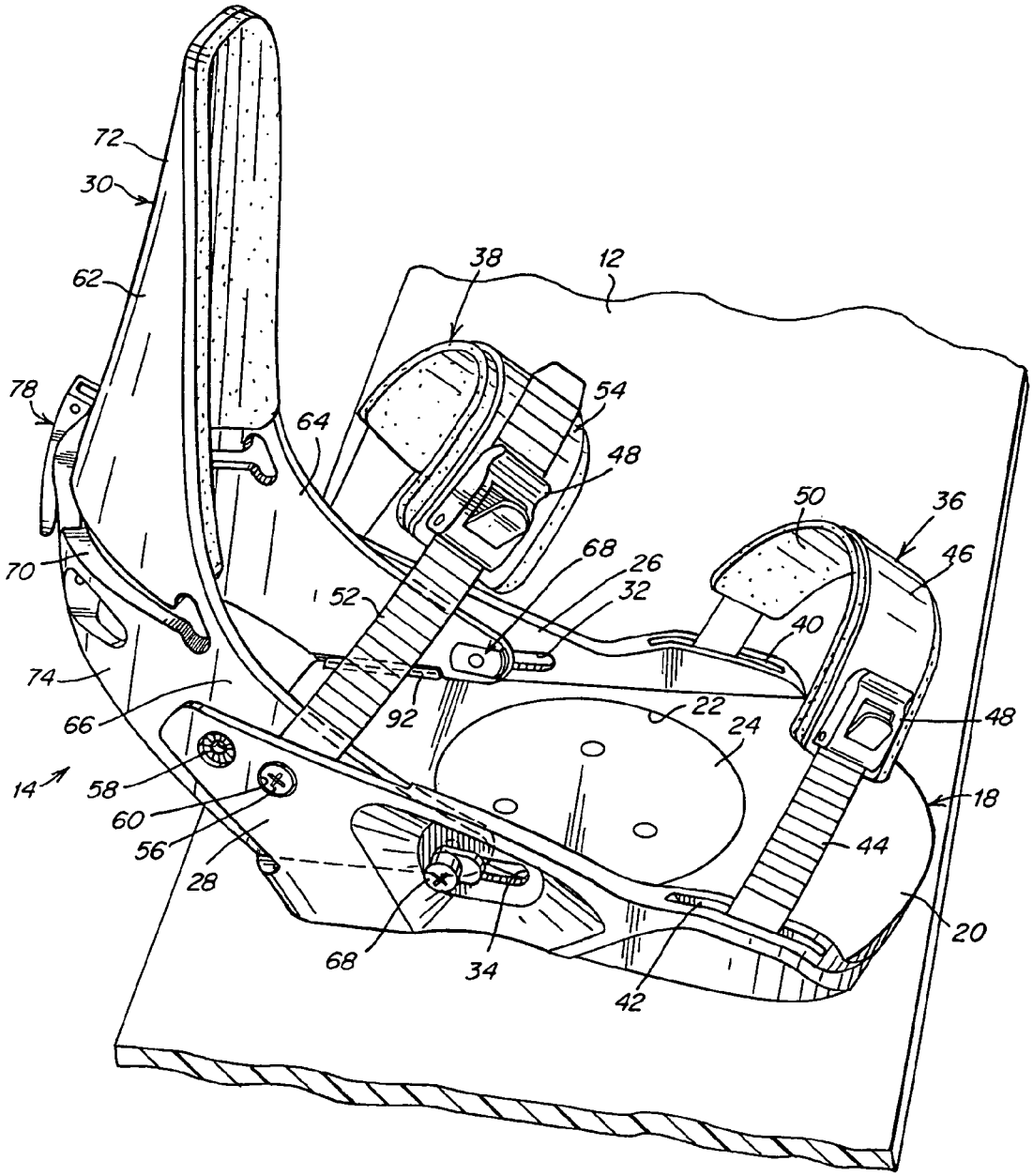
FIG. 2 is a perspective view of one illustrative embodiment of a binding in accordance with the invention mounted on a snowboard.

FIG. 2 illustrates the binding 14 shown in FIG. 1, which is specifically adapted for the right foot of the rider. It should be understood that the binding for the left foot is substantially a mirror image of the right foot binding 14 shown in FIG. 2. The binding 14 includes a base generally indicated at 18 having a base plate 20 that is adapted to be mounted on the snowboard 12. The base plate 20 has a central opening 22 formed therein that is adapted to receive a hold-down disc 24 in a conventional manner. Although not specifically shown, the bottom surface of the hold-down disc 24 includes a plurality of ridges that are adapted to engage corresponding ridges in the area of the base plate 20 that defines the central opening 22, i.e., around the periphery of the central opening. Thus, the base plate 20 of the binding 14 can be adjusted to a plurality of different positions with respect to the hold-down disc 24, thereby enabling the rider to orient the base plate and thus the binding 14 to suit the rider's preference.

In certain embodiments not shown in the drawings, the hold-down disc 24 may be configured with a different hole pattern, such as a four-by-four hole pattern, so as to mount the hold-down disc and therefore the binding 14 onto the snowboard 12. In other embodiments, the hole pattern may be a triangular hole pattern that includes a set of multiple repetitions of holes that are adapted to receive screws to mount the binding 14 to the snowboard 12. This construction enables, among other things, the position of the bindings 14 on the snowboard 12 to be adjusted to accommodate different riding stances. Additionally, the hold-down disc 24 may be constructed in a variety of different ways so long as it is capable of fastening the base plate to the snowboard. For example, more than one hold-down disc may be provided to suit different types of snowboards.

As shown, the base 18 of the binding 14 may further include a pair of side rails 26, 28 that extend upwardly from the base plate 20 along the lateral sides of the base plate. The side rails 26, 28 are spaced apart from another and are shaped so as to accommodate the rider's boot in between. At the rear (i.e., the heel) end of the base plate 20, the walls of the side rails 26, 28 extend upwardly in a pronounced manner and terminate prior to reaching the rear or back end of the base plate thereby creating an open end (see FIG. 3). As best shown in FIG. 2, each side rail 26 and 28 is generally triangularly-shaped to form an incline starting at the front of the base plate 20 toward the rear of the base plate. The base plate 20 and the side rails 26, 28 may be formed from a single integral molded piece of material, such as nylon. The hold-down disc 24 may also be fabricated from similar material.

The binding shown in FIG. 2 further includes a high-back support generally indicated at 30 attached at two adjustable connection points on the lateral walls of the side rails 26, 28 of the base 18. The high-back support 30 is configured so as to engage the back of the rider's lower leg. The particular attachment of the high-back support 30 to the side rails 26, 28 of the base 18 will be described in greater detail below. As shown, slots 32, 34 are formed in respective side rails 26, 28 to provide the adjustable positioning of the high-back support 30 with respect to the base 18. The adjustable attachment points achieved by this configuration enable the high-back support 30 to not only be folded down when not in use, but also to be rotated about an axis that is substantially normal to the base plate 20 of the base 18. A more detailed description of the movement and operation of the high-back support 30 with respect to the base 18 will be described in greater detail as the description of the invention proceeds.

As with the strap bindings described above, the binding 14 of embodiments of the invention may include one or more straps to secure the rider's boot in the binding. Specifically, in the shown embodiment, a toe strap generally indicated at 36 and an ankle or heel strap generally indicated at 38 may be provided. While shown and described as distinct toe and ankle straps herein, it should be appreciated that the toe and ankle straps may be interconnected by material covering the instep area through which the toe and ankle straps are threaded. As shown in FIG. 2, a pair of slits 40, 42 formed in respective side rails 26, 28 are configured to attach the toe strap 36 by means of a fastener (not shown), for securing the front of the rider's boot in the binding 14. The strap material may be of the type used as the toe or ankle strap in conventional strap bindings, or may be any other type of suitable strap. In one embodiment of the invention, the toe strap 36 includes a first strap portion 44 attached to the lateral side of the binding 14, and a second strap portion 46 attached to the medial side of the binding. The lateral strap portion 44 includes a plurality of teeth that are adapted to engage with a locking mechanism 48 that is attached to the free end of the medial strap portion 46. In a certain embodiment, the locking mechanism 48 may be a ratchet-type buckle that is well known in the art, although numerous other locking mechanisms are possible.

Once the teeth of the lateral strap portion 44 are engaged with the buckle of the locking mechanism 48, the ratcheting feature of the locking mechanism may be used to tighten the toe strap 36 down over the front of the rider's boot in the toe area. In a certain embodiment, the medial strap portion 46 may include a pad 50 disposed over the inner surface of the strap portion to cushion the top of the rider's foot as the toe strap 36 is tightened down over the top of the boot. In addition, although not shown, the toe strap may be split in the middle area so that the strap does not bear upon the top of the rider's instep bone. In other configurations, the medial strap portion may further include a plurality of openings so that the attachment point of the second strap portion to the binding may be adjusted to accommodate different boot sizes.

The operation of the ankle strap 38 is substantially the same as the toe strap described above. As shown, the ankle strap portions 52, 54 are secured by fasteners 56 to the side rails 26, 28 adjacent the back ends of the side rails by means of one of two openings 58, 60 formed in the side rails. Additional openings may be provided to increase the level of adjustability of the ankle strap 38. It should be understood that the specific strap arrangement shown in the drawings and described above is provided merely for illustrative purposes, and that the invention is not limited to any particular strap arrangement. The provision of at least one strap that is tightened down over the top of the rider's boot enables the sole of the boot to roll laterally during riding while providing a secure attachment to the snowboard.

The binding straps 36, 38 may provide some flexibility, such as a typical strap in a conventional strap binding, which may be formed from an injection molded plastic (e.g., polyurethane), woven nylon, or any of a number of other flexible materials. In addition, the locking mechanisms 48 employed with the straps may operate to securely hold the heel of the boot in the binding, while still providing enough give to enable the sole of the boot to roll laterally. However, even though a binding having straps is illustrated in the drawings and described herein, it should be understood that the principles of the invention may be applied to bindings not having straps, such as the step-in binding mentioned above.

Figure 3:
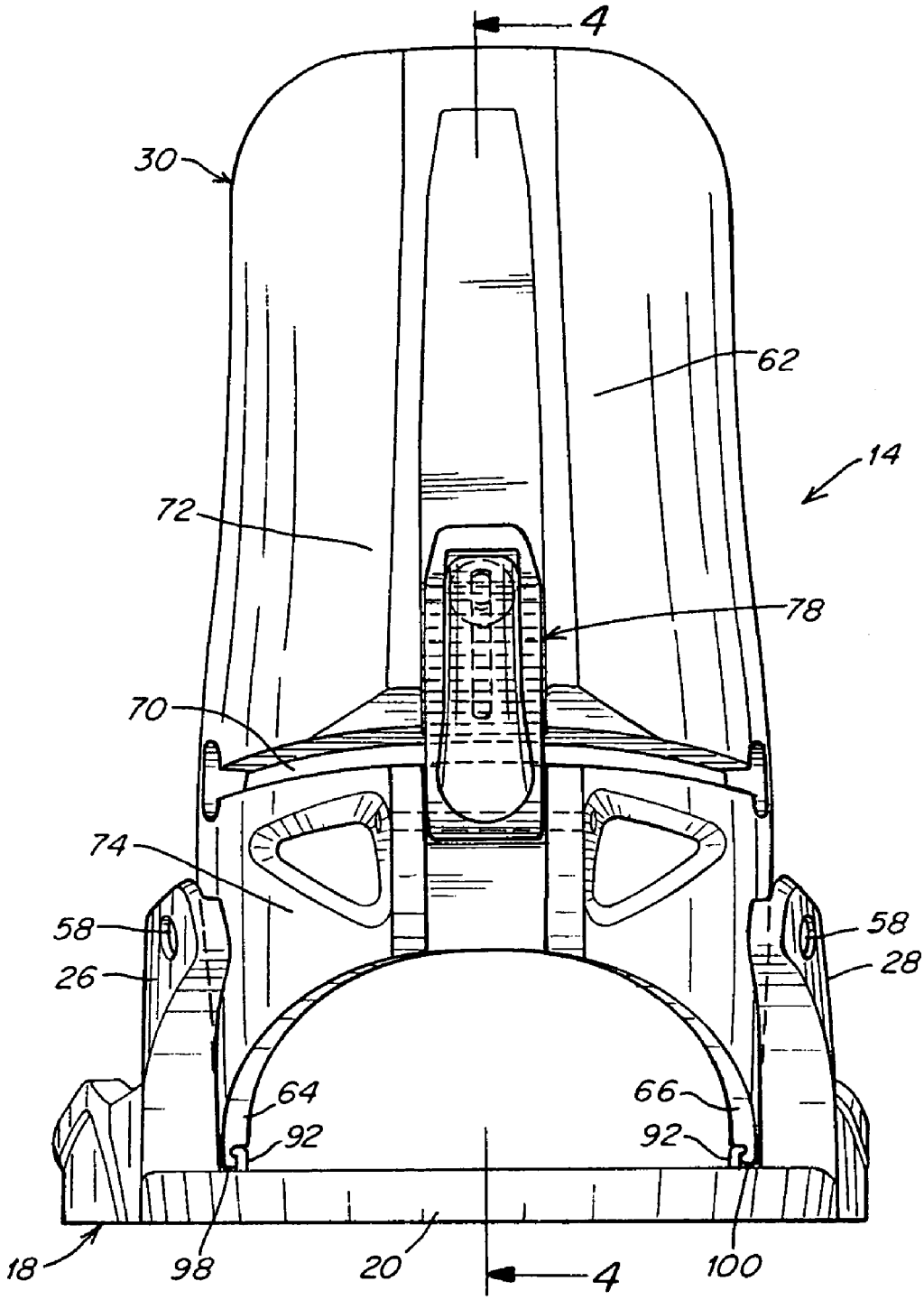
FIG. 3 is a rear view of the binding shown in FIG. 2.

Turning now to FIGS. 2 and 3, the high-back support 30 includes a main body 62 and a pair of downwardly descending arms 64, 66 integrally formed with the main body. The main body 62 is shaped to engage the back of the rider's lower leg. Each arm 64, 66 is secured to its respective side rail 26 or 28 by a fastener assembly 68, which is configured to secure the arm to its respective side rail within its respective slot 32 or 34. As shown, the slots 32, 34 provided in the side rails 26, 28, respectively, enable the high-back support 30 to be adjusted with respect to the base 18 in a front to back direction so as to accommodate larger and smaller boots. Specifically, each slot 32, 34 has a length D (see FIG. 4). The arrangement is such that the fastener 68 may be secured anywhere along the length of its respective slot 32 or 34 so as to adjust the high-back support 30 to the rider's boot length. The fasteners 68 also enable the pivotal movement of the high-back support 30 with respect to the base 18 so that the high-back support is pivotable between a stowed position in which the main body 62 of the high-back support is disposed generally against the base plate 20 of the base and a use position in which the high-back support extends away from the base plate in the position shown in FIG. 2. This pivotal movement of the high-back support 30 with respect to the base is illustrated in dashed lines in FIG. 5.

Thus, it should be observed that the high-back support as shown and described herein is capable of being mounted directly onto the base without the need of a heel loop as with prior art snowboard bindings without sacrificing functionality normally associated with such prior art snowboard bindings.

Figures 4, 6:
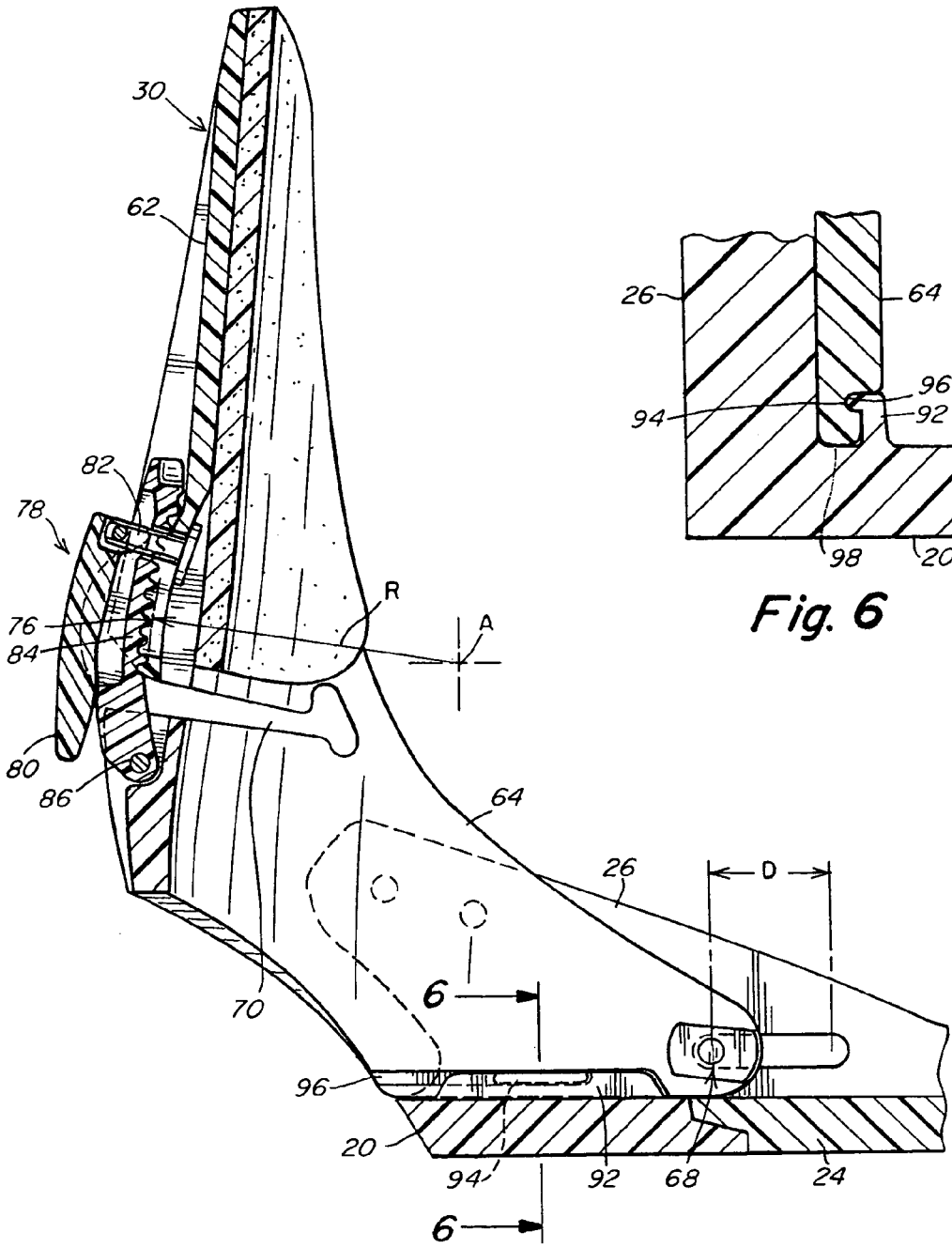
FIG. 4 is a cross-sectional view taken along line 4-4 of FIG. 3.
FIG. 6 is a cross-sectional view taken along line 6-6 of FIG. 4.

As shown in FIGS. 3 and 4, the high-back support 30 may be fabricated from a single piece of material configured to include a flexible hinge 70 formed therein to adjust a forward lean position of the high-back support. Specifically, the main body 62 of the high-back support is formed to curve around the rider's lower leg and ankle, with the flexible hinge 70 extending from one side of the main body to the other side of the main body. The flexible hinge 70 is formed as a relatively large slot with even larger openings formed at the ends of the slot so as to enable the flexible movement of a top portion 72 of the main body 62 with respect to a bottom portion 74 of the main body. The flexible hinge 70 may be referred to in the art as a "living" hinge. Thus, by securing the flexible hinge 70 in a certain position in the manner described below, the forward lean position may be adjusted and fixed to the rider's preference. As shown in FIG. 3, two smaller openings (not designated) may be formed in the bottom portion 74 of the main body 62 to, among other things, reduce the overall weight of the binding 14.

Figure 7:
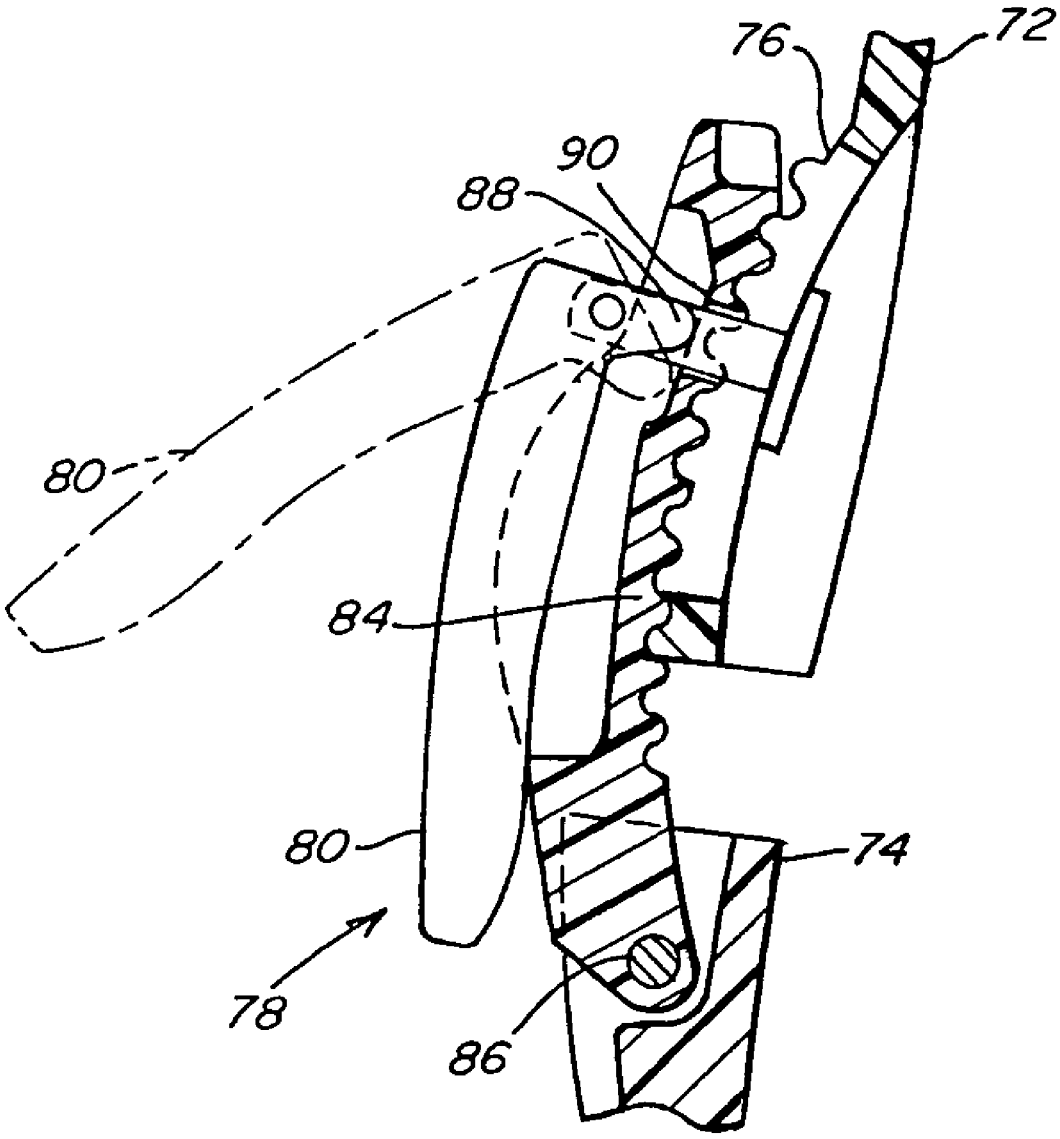
FIG. 7 is an enlarged cross-sectional view of a forward lean adjustment mechanism of the binding.

As best shown in FIGS. 4 and 7, the main body 62 of the high-back support 30 is also curved about pivot point A so as to create a curved surface 76 having a radius R at an area surrounding the hinge 70. To secure the high-back support 30 in a desired forward lean position, the high-back support also includes a locking mechanism generally indicated at 78 secured to the main body 62 of the high-back support at the curved surface 76. As shown, the locking mechanism 78 includes a latch 80 that is pivotally secured to the main body 62 by a pin assembly 82. Referring to FIG. 7, the latch 80 is capable of moving between a locked position in which the latch 80 is disposed against the main body 62 and an unlocked position in which the latch is rotated clockwise so as to extend generally away from the main body 62 of the high-back support 30. The unlocked position of the latch 80 is illustrated by phantom lines in FIG. 7. The locking mechanism 78 further includes a curved segment 84 having teeth formed therein, with the curved segment being secured to the main body 62 by a pin 86. The curved surface 76 of main body has teeth formed therein, which are configured to mate with the teeth of the curved segment 84. The provision of the teeth of the curved surface 76 meshing with the teeth of the curved segment 84 enable a more secure, positive coupling of the locking mechanism 78 when moved to its locked position. Specifically, the curved teeth allow for proper engagement when locking the forward lean adjustment in place and further enable a simpler one-piece pivot construction. The radius R may be varied based on design consideration.

The geometry of the flexible hinge 70 is configured to allow the forward lean adjustment of the high-back support 30 to engage the rider's lower leg in all forward lean positions with only one pivot point, which is defined by the flexible hinge. Prior art high-back supports typically include two pivot points (one pivot point between the high-back support and the heel loop and a second pivot point between the heel loop and the base). Furthermore, with the forward lean adjustment of embodiments of the invention, the pivot point is positioned higher on the high-back support than with prior art forward lean adjustments. In addition, the provision of the curved teeth enables the single pivot point. In certain embodiments, the radius R of the parts comprising the curved teeth is substantially equal to a radius about which the top portion rotates with respect to the bottom portion about hinge 70. In other embodiments, the pivot point of the top portion with respect to the bottom portion and the center of the curved teeth may be the same.

Figure 5:
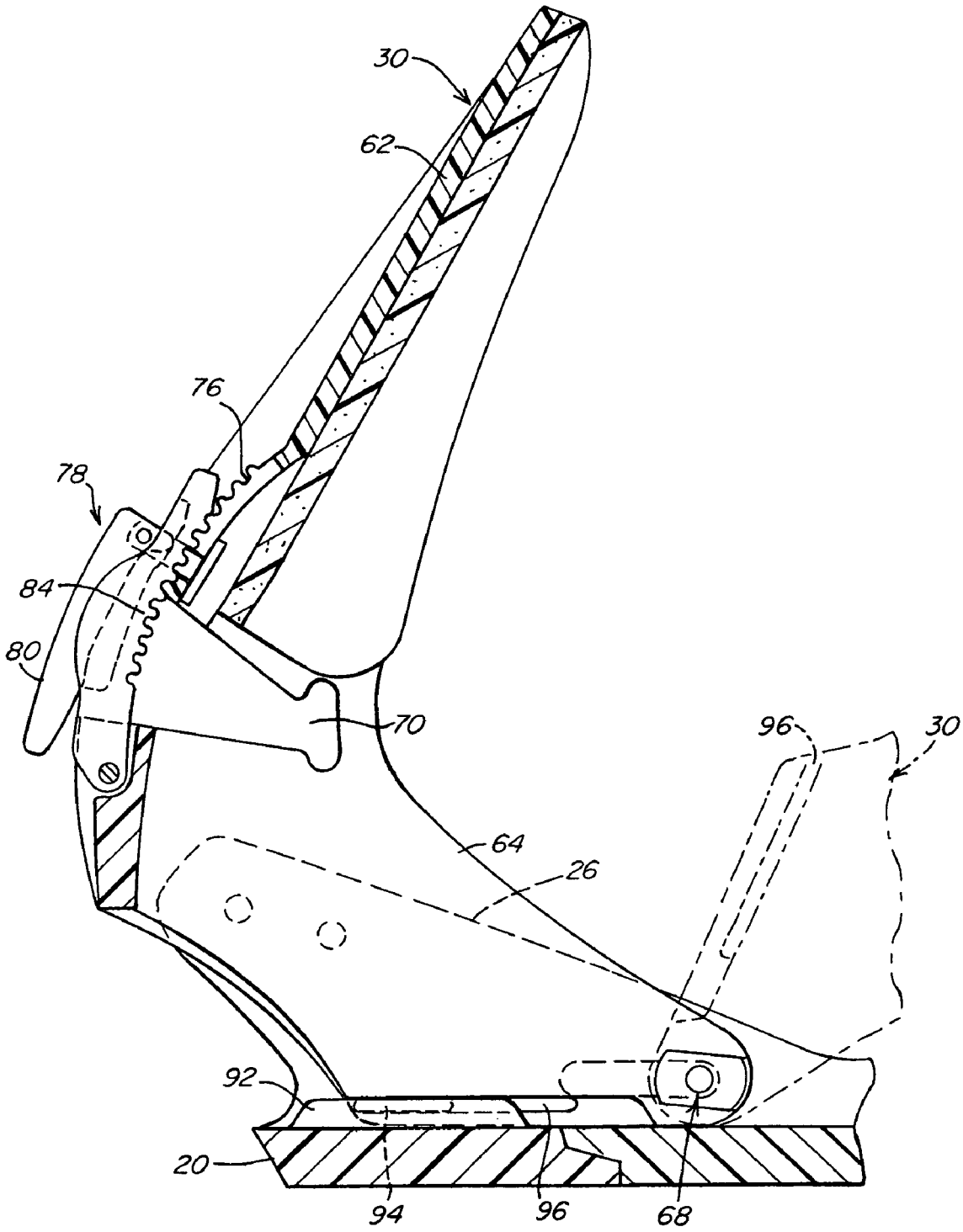
FIG. 5 is a cross-sectional view of the binding showing the adjustment of a forward lean adjustment of the binding.

The arrangement is such that by flexing the top portion 72 of the main body 62 with respect to the bottom portion 74 of the main body with the latch 80 in its unlocked position, the forward lean position may be adjusted by the rider. Once the rider adjusts the forward lean to a desired position, the latch 80 may be pivoted counterclockwise to its locked position so as to securely clamp the curved segment 84 against the curved surface 76 thereby interlocking the teeth of the curved segment with the teeth of the curved surface. The latch 80 may include a cam portion 88 configured to mate with a cam surface 90 of the curved segment 84 so as to apply pressure on the curved segment when moving the latch from its unlocked position to its shown locked position. FIG. 5 illustrates the high-back support 30 in an aggressive forward lean position with the width of the slot formed by the flexible hinge 70 being flexed so as to create a larger slot width. Specifically, the top portion 72 may be angled with respect to the bottom portion 74. The arrangement is such that the top portion 72 is canted forward with respect to the bottom portion 74 so as to apply pressure on the back of the rider's lower leg.

As discussed above, the high-back support 30 is pivotable between a stowed position in which the high-back support is disposed generally against the base 18 and a use position in which the high-back support extends away from the base. With reference to FIGS. 3 and 6, to secure the high-back support 30 in its use position, a releasable securing feature associated with the base 18 and the high-back support 30 is further provided. Specifically, a releasable securing feature is associated with the base 18 adjacent both side rails 26, 28 and their respective descending arms 64, 66. FIG. 6 illustrates the base 18 and one such side rail 26 and descending arm 64, it being understood that the other side rail 28 and the other descending arm 66 operate in an identical manner.

The releasable securing feature, with respect to the base 18 adjacent side rail 26 and the descending arm 64 illustrated in FIG. 6, includes a first interconnecting portion associated with the base plate 20 and a second interconnecting portion associated with the descending arm 64. Specifically, the base plate 20 of the base 18 may be configured with an elongate ridge 92 disposed adjacent to its respective side rail 26, the ridge having a detent 94 formed along an outside edge of the ridge. The descending arm 64 of the high-back support 30 includes an elongate slot 96 formed adjacent a lower edge of the descending arm. The arrangement is such that when moving the high-back support 30 to its use position, the detent 94 of the ridge 92 is disposed within the elongate slot 96 of the descending arm 64 so as to positively secure the descending arm in place. However, given the flexible nature of the material from which the high-back support 30 and base 18 are fabricated, the high-back support may be moved back to its stowed position by applying a force to rotate the high-back support clockwise (FIG. 4). It should be understood that other configurations may be provided to secure the high-back support 30 in its use position. For example, the slot may be provided in the side rail 26 or 28 and the detent may be provided on the descending arm 64, 66. Also, the sizes of the detents 94 and their respective slots 96 may be manipulated to increase or decrease the strength at which the high-back support 30 is secured to the base 18 and the force required to move the high-back support to its stowed position. Additionally, the lengths of the detents 94 and the slots 96 may be lengthened or shortened depending on design constraints. And finally, although relatively straight ridges 92 and slots 96 are shown in the drawings, the construction of these features may be changed for design purposes.

This construction enables the forward and back adjustment of the high-back support 30 while maintaining the high-back support in a secured position with the detents 94 of the ridges 92 disposed within the slots 96. Specifically, the fastener assemblies 68 associated with side rails 26, 28 and descending arms 64, 66, respectively, may be loosened to enable the forward and backward adjustment of the high-back support 30. During adjustment, the detents 94 slide within their respective slots 92 when moving the high-back support 30 from front to back and from back to front with respect to the base 18.

Each descending arm 64 and 66 further includes a bottom surface 98, 100, respectively, configured to engage the top surface of the base plate 20 between the side rails 26, 28 and their respective ridges 92 to transfer a load from the high-back support to the base plate. The arrangement is such that force applied by the rider during use is directed from the main body 62 of the high-back support 30 down through a descending arm (64 or 66 depending on the direction of turn of the rider), to the base plate 20 via the bottom surface 98 or 100 of the descending arm. Thus, this arrangement enables the displacement of heel side forces during riding. The feature enables the binding to create a rigid body and superior heel hold.

Thus, it should be observed that the snowboard binding of the invention is capable of adjusting a forward lean of a snowboard binding to suit the rider's preference while maintaining intimate contact of the bottom surfaces 98, 100 of the descending arms 64, 66 of the high-back support 30 with the base 18. This adjustment may be made by flexing the high-back support by moving the top portion of the high-back support with respect to the bottom portion to a desired forward lean position. With the latch, the high-back support may be locked in place in the desired forward lean position by means of engaging teeth formed in the curved surface of the high-back support with teeth formed in the curved segment of the locking mechanism. In addition, the snowboard binding disclosed herein is capable of pivotally moving the high-back portion with respect to a base of the snowboard binding between the use position in which the high-back support extends away from the base to the stowed position in which the high-back support is disposed against the base.

Furthermore, the snowboard binding is capable of securing the high-back support to a base of a snowboard binding in a use position. The releasable securing feature associated with the base may engage the releasable securing feature associated with the high-back support to releasably secure the high-back support in the use position. Specifically, the interconnecting portions associated the base adjacent the side rails interlock with the interconnecting portions associated with the descending arms. Front-to-back adjustment of the high-back support may further take place when the high-back support is locked into its use position.

Although the particular features disclosed herein have been described above in connection with a binding that includes straps for holding down the rider's boot in the binding, it should be understood that these features of the invention are not so limited. In particular, the features described above, e.g., the living hinge and releasable securing feature, can alternatively be employed with other types of bindings, such as step-in bindings.

In addition, the forward lean adjustment mechanism in accordance with the invention may be implemented in any number of ways. Although the illustrative embodiment of the invention shown in the drawings employ a locking mechanism having teeth that engage teeth formed on the main body of the high-back support, the invention is not so limited to this particular construction. For example, a hook may be provided in place of the teeth for latching the locking mechanism in place. Similarly, the releasable securing feature may embody other designs as well. For example, slots may be formed in the side rails of the base and the detents formed in the descending arms of the high-back support.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A snowboard binding for securing a boot to a snowboard, the snowboard binding comprising:

a base configured to be mounted to the snowboard, the base having a base plate and a pair of the side rails that extend upwardly from the base plate along lateral sides of the base plate; and a high-back pivotally secured to the base, the high-back being pivotable between a stowed position in which the high-back is disposed against the base and a use position in which the high-back extends away from the base in an upright position, the high-back having a leg engagement portion and a pair of descending arms, each arm including a surface configured to engage the base plate of the base adjacent the side rails to transfer a load from the leg engagement portion directly to the base plate when the high-back is in its use position.

2. The snowboard binding of claim 1, further comprising a releasable securing feature associated with the base and the high-back to releasably secure the high-back in the use position.

3. The snowboard binding of claim 2, wherein the releasable securing feature includes a first interconnecting portion associated with the base adjacent one of the side rails and a second interconnecting portion associated with one of the arms, the first and second interconnecting portions being releasably engagable with one another for securing the high-back in its use position.

4. The snowboard binding of claim 1, wherein the high-back is fabricated from a single piece of material and having a hinge formed therein to adjust a forward lean position of the high-back.

5. The snowboard binding of claim 4, wherein the main body has a top portion and a bottom portion, with the hinge being disposed between the top portion and the bottom portion.

6. The snowboard binding of claim 5, wherein the main body has a curved surface at an area surrounding the hinge.

7. The snowboard binding of claim 6, further comprising a locking mechanism secured to the main body of the high-back at the curved surface.

8. The snowboard binding of claim 7, wherein the curved surface has teeth formed therein, and wherein the locking mechanism has teeth configured to mate with the teeth of the curved surface.

9. The snowboard binding of claim 8, wherein the locking mechanism is pivotally connected to the main body of the high-back.

10. The snowboard binding of claim 1, wherein the arms of the high-back are pivotally secured to their respective side rails of the base.

11. The snowboard binding of claim 10, further comprising a releasable securing feature associated with the side rails and the high-back to releasably secure the high-back in the use position.

12. The snowboard binding of claim 11, wherein the releasable securing feature includes a first interconnecting portion associated with each side rail and a second interconnecting portion associated with each of the descending arms, the first and second interconnecting portions being releasably engagable with one another for securing the high-back in its use position.

13. A snowboard binding for securing a boot to a snowboard, the snowboard binding comprising:

a base configured to be mounted to the snowboard; and a high-back pivotally secured to the base, the high-back being pivotable between a stowed position in which the high-back is disposed against the base and a use position in which the high-back extends away from the base in an upright position, the high-back having a leg engagement portion and a pair of descending arms, each arm including a surface configured to engage the base to transfer a load from the leg engagement portion directly to the base when the high-back is in its use position.

14. The snowboard binding of claim 13, further comprising a releasable securing feature associated with the base and the high-back to releasably secure the high-back in the use position.

15. The snowboard binding of claim 14, wherein the releasable securing feature includes a first interconnecting portion associated with the base and a second interconnecting portion associated with one of the descending arms, the first and second interconnecting portions being releasably engagable with one another for securing the high-back in its use position.

16. The snowboard binding of claim 13, wherein the high-back is fabricated from a single piece of material and having a hinge formed therein to adjust a forward lean position of the high-back.

17. The snowboard binding of claim 16, wherein the main body has a top portion and a bottom portion, with the hinge being disposed between the top portion and the bottom portion.

18. The snowboard binding of claim 17, wherein the main body has a curved surface at an area surrounding the hinge.

19. The snowboard binding of claim 18, further comprising a locking mechanism secured to the main body of the high-back at the curved surface.

20. The snowboard binding of claim 19, wherein the curved surface has teeth formed therein, and wherein the locking mechanism has teeth configured to mate with the teeth of the curved surface.

21. The snowboard binding of claim 20, wherein the locking mechanism is pivotally connected to the main body of the high-back.

22. The snowboard binding of claim 13, wherein the base has a base plate and a pair of the side rails that extend upwardly from the base plate along lateral sides of the base plate, and wherein the arms of the high-back are pivotally secured to their respective side rails of the base.

23. The snowboard binding of claim 22, further comprising a releasable securing feature associated with the side rails and the high-back to releasably secure the high-back in the use position.

24. The snowboard binding of claim 23, wherein the releasable securing feature includes a first interconnecting portion associated with each side rail and a second interconnecting portion associated with each of the descending arms, the first and second interconnecting portions being releasably engagable with one another for securing the high-back in its use position.

* * * * *